United States Patent [19]

Moore et al.

[11] 4,066,052

[45] Jan. 3, 1978

[54] EXHAUST RECYCLING AND CARBON MONOXIDE ELIMINATOR FOR COMBUSTION ENGINES

[76] Inventors: Leota J. Moore, 910 Lake Shore Drive, Chicago, Ill. 60611; Robert G. Landwer, 1454 W. Argyle, Chicago, Ill. 60640

[21] Appl. No.: 734,438

[22] Filed: Oct. 21, 1976

[51] Int. Cl.[2] ..... F02M 25/06

[52] U.S. Cl. ..... 123/119 A; 181/212; 181/264; 181/36 E

[58] Field of Search ..... 123/119 A; 181/33 R, 181/33 A, 36 E

[56] References Cited

U.S. PATENT DOCUMENTS

| | | | |
|---|---|---|---|
| 1,848,561 | 3/1932 | Goldstein | 123/119 A |
| 3,294,703 | 12/1966 | Bressan | 123/119 A |
| 3,412,722 | 11/1968 | Epifanio, Sr. | 123/119 A |
| 3,476,524 | 11/1969 | Burke | 123/119 A X |
| 3,730,160 | 5/1973 | Hughes | 123/119 A X |
| 3,861,367 | 1/1975 | Kelmar | 123/119 A |
| 3,885,538 | 5/1975 | Suter | 123/119 A |
| 4,011,846 | 3/1977 | Gagliardi | 123/119 A |

*Primary Examiner*—Wendell E. Burns
*Attorney, Agent, or Firm*—B. P. Fishburne, Jr.

[57] ABSTRACT

An accessory or attachment device for existing or newly manufactured internal combustion engines bleeds incompletely burned combustion products from the engine exhaust upstream from the exhaust manifold and returns or recycles the combustion products through the carburetor to the combustion chambers of the engine where complete burning of the products takes place. Carbon monoxide in the final exhaust from the engine is reduced almost to zero and substantially the full energy present in the hydrocarbon fuel is utilized, rather than being wasted into the atmosphere as occurs in conventional engines. The device subjects the recycled combustion products to violent agitation and comminution before returning them through the carburetor to the engine fuel induction system.

9 Claims, 5 Drawing Figures

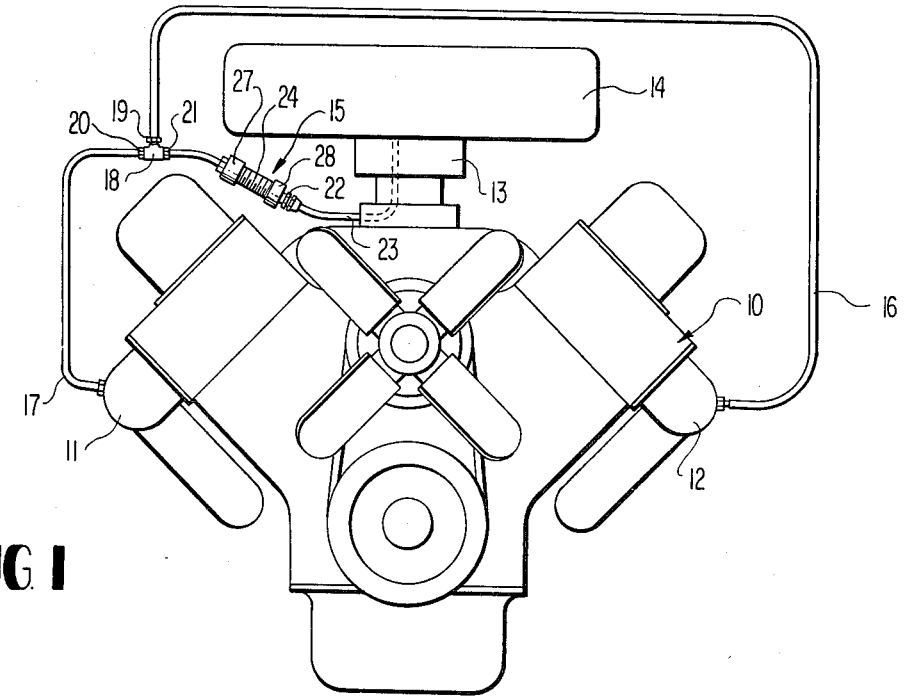
FIG. 1
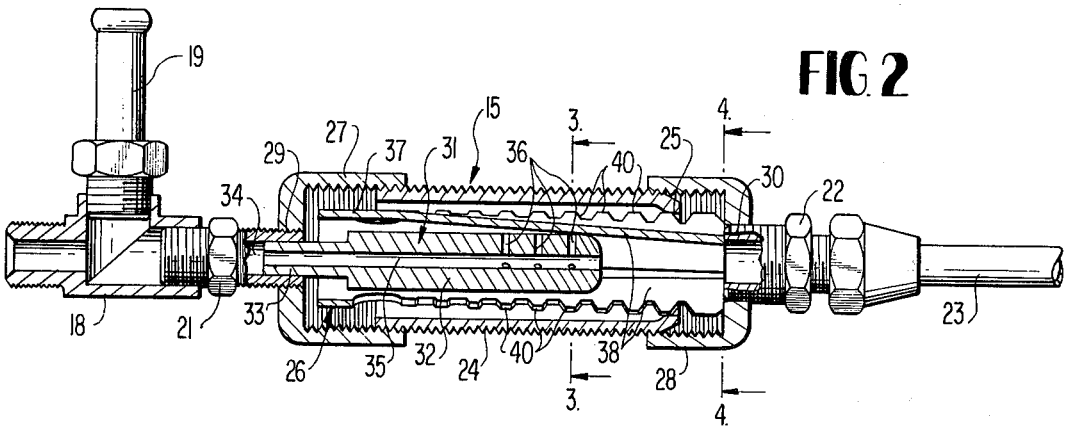
FIG. 2
FIG. 3
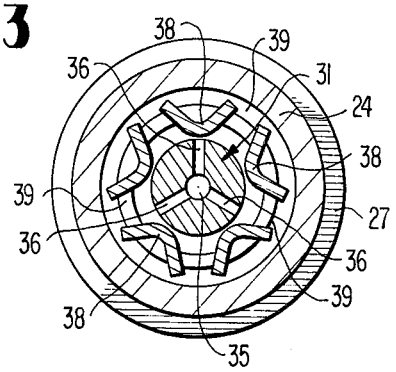
FIG. 4
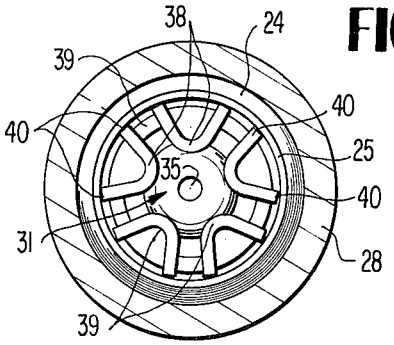

EXHAUST RECYCLING AND CARBON MONOXIDE ELIMINATOR FOR COMBUSTION ENGINES

BACKGROUND OF THE INVENTION

Many devices have been proposed in the prior art for controlling or reducing air pollution caused by the exhaust products of internal combustion engines. Some of these devices have proposed recycling or reburning of exhaust gases to rid them of pollutants and to derive otherwise wasted energy from the incompletely burned exhaust products. While many such prior art devices function as intended in varying degrees, none has proven ultimately successful and practical for a variety of reasons. Among the reasons are excessive cost of manufacturing, complexity of construction, bulkiness, need for frequent adjustment, and adverse effect on engine performance. Some random examples of the patented prior art disclosed in U.S. Pat. Nos. 3,537,829; 3,866,586; 3,926,161 and 3,800,533.

The object of this invention is, therefore, to improve on the known prior art through the provision of a small, simple and comparatively economical attachment device for internal combustion engines which will divert incompletely burned products of combustion from the exhaust stream and recycle them through the fuel induction system of the engine with agitation and comminution to thereby completely utilize the energy of the fuel and reduce pollutants in the final exhaust from the engine including notably almost complete elimination of carbon monoxide. The attachment or accessory device is characterized by compactness, reliability, efficiency of operation and the absence of need for adjustment once properly installed.

SUMMARY OF THE INVENTION

A threaded nipple or sleeve contains interfitting male and female elements which act on hot exhaust products diverted from the engine exhaust manifold system to agitate, break up and comminute the products prior to delivering them to the carburetor air intake along with inducted cold air. The male element has a central axial passage and a multiplicity of radiating ports leading therefrom. The surrounding female element is a slotted sleeve with finger portions thereof between the slots formed as outwardly facing channels whose edges are toothed longitudinally of the device. The nipple containing the male and female elements is coupled at its ends with pipes or tubes leading from the exhaust manifold system and to the carburetor.

Other features and advantages of the invention will appear during the course of the following detailed description.

BRIEF DESCRIPTION OF THE DRAWINGS

FIG. 1 is a end elevational view of an engine equipped with the unit embodying the invention.

FIG. 2 is an enlarged central vertical section through the invention, partly in elevation.

FIG. 3 is a transverse vertical section taken on line 3—3 of FIG. 2.

FIG. 4 is a similar section taken on line 4—4 of FIG. 2.

DETAILED DESCRIPTION

Figure 5:
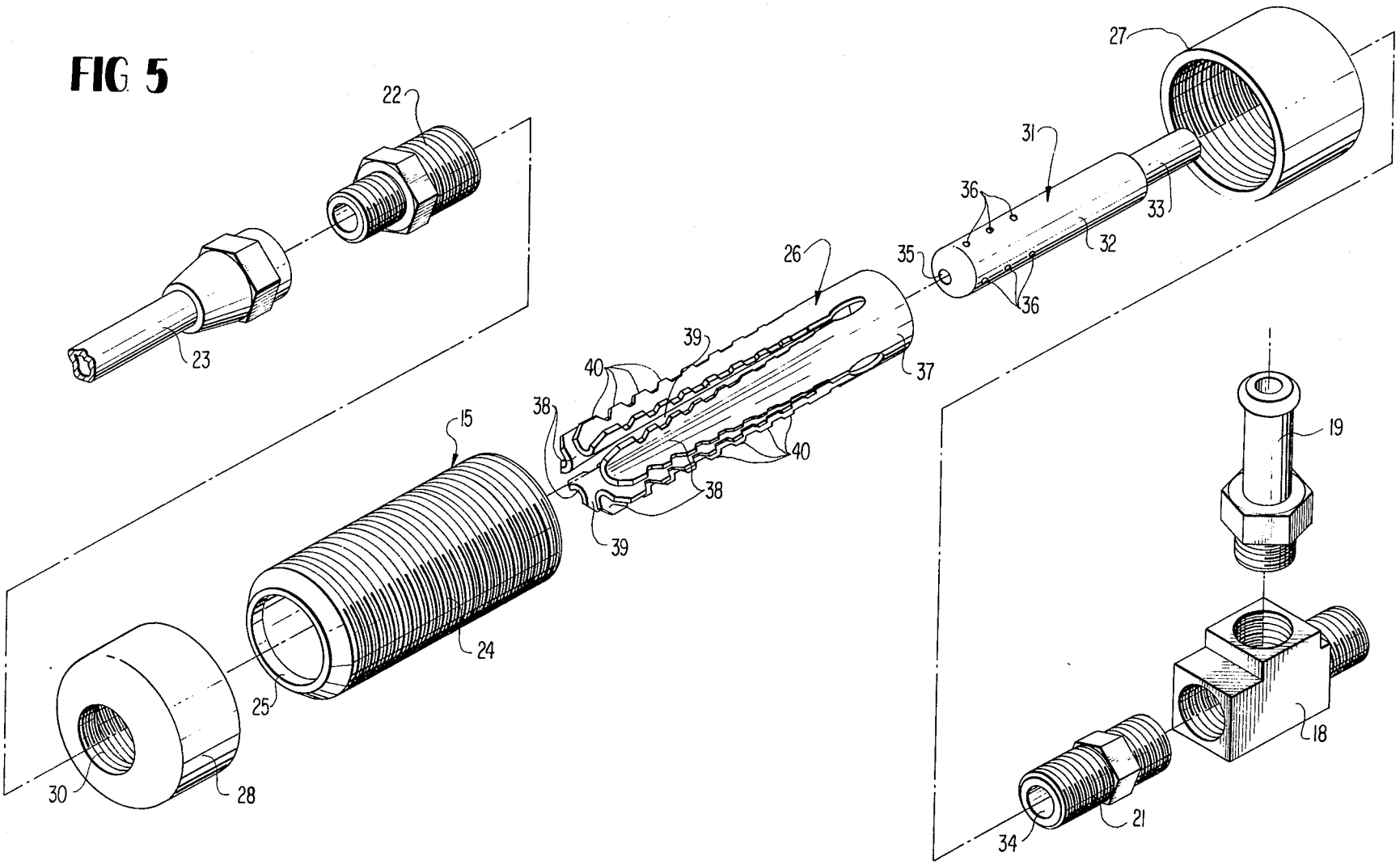
FIG. 5 is an exploded perspective view of the invention.

Referring to the drawings in detail, wherein like numerals designate like parts, attention is directed first to FIG. 1 wherein a conventional V-type internal combustion engine 10 is illustrated having a pair of exhaust manifolds 11 and 12 and a carburetor 13 carrying the usual air cleaner 14. The exhaust manifolds 11 and 12 lead to single or separate exhaust pipes, not shown, having suitable muffler means connected therein. The invention proper comprises an attachment or accessory unit 15 for recycling incompletely burned combustion products from the manifolds 11 and 12, back to the combustion chambers of the engine, through the air intake means of the carburetor 13. This recycling of combustion products substantially eliminates carbon monoxide in the final exhaust from the engine and utilizes otherwise wasted energy in the fuel by substantially completely burning the recycled hydrocarbons. Engine efficiency or mileage is notably improved. The ultimate exhaust from the engine is essentially free of pollutants.

The accessory recycling unit 15 is connected into the exhaust manifold 11 and 12 upstream from the muffler and final exhaust pipe means by comparatively small pipes 16 and 17 which divert and direct hot exhaust gases including some unburned fuel to the recycling unit 15. Both pipes 16 and 17 lead into a common T-fitting 18 and are securely coupled therewith by fittings 19 and 20. The T-fitting 18 is coupled with the unit 15 proper through another tubular threaded fitting 21. A similar fitting 22 serves to couple the other end of the unit 15 with a line or pipe 23 extending to the air intake means of the carburetor 13 where the recycled exhaust gases are delivered directly into the cold air stream being inducted into the engine. The mixing of the hot gaseous products with the incoming cold air tends to increase the down draft through the carburetor and generally increases the efficiency of the engine induction system, thus aiding in the recycling flow.

The heart of the invention lies in the construction and operation of the unit 15 illustrated in detail in FIGS. 2 to 5. This unit or assembly comprises an externally threaded sleeve or nipple 24 constituting a housing for interior parts, to be described. At its end away from the fitting 21, nipple 24 has a reduced diameter cylindrical collar 25 thereon for the support of a female agitator and comminuting sleeve 26, to be fully described. The ends of threaded nipple 24 are connected by a pair of coupling nuts 27 and 28 with the respective upstream and downstream tubular fittings 21 and 22, the coupling nuts also having threaded bores 29 and 30 to receive the threaded fittings 21 and 22. The elements 24, 27 and 28, when assembled, constitute a securely closed housing for the critical male and female exhaust treatment elements of the invention, now to be described.

A male jet or nozzle element 31 forming a key element of the invention has an elongated cylindrical body portion 32 and a somewhat reduced diameter upstream end extension 33 which fits snugly into the bore 34 of fitting 21. The jet 31 has a main central axial bore 35 formed therethrough from end-to-end for the conduction of hot partly unburned combustion products taken from the exhaust manifolds 11 and 12 through pipes 16 and 17. The jet or nozzle 31 is additionally provided in its downstream end portion with preferably three circumferentially equidistantly spaced rows of longitudinally spaced small radial ports 36 which open through the exterior surface of the jet 31 and communicate with the central bore or passage 35 which is larger in diameter than the ports 36. Comparatively, the small ports 36 may be approximately 1/32 of an inch in diameter and the central bore 35 may be approximately 1/16 of an inch in diameter. The invention is not restricted, in terms of dimensions, however, and the relative sizes of parts may be varied depending upon engine size and other variables. Preferably, there are three of the ports 36 in each row, as illustrated, but again, the number and spacing of the radial ports may be varied.

The recycling unit 15 further comprises the beforenamed female sleeve 26 which interfits telescopically with the male jet 31 in the assembly and which is bodily supported and centered in the threaded nipple 15. More particularly, the female sleeve 26 has a short cylindrical upstream end portion 37 which is suspended centrally in the coupling nut 27, FIG. 2. Forwardly of the end portion 37, sleeve 26 is slotted longitudinally to form thereon preferably five circumferentially spaced equal length elongated fingers 38. The fingers 38 are channel-like and roughly V-shaped in cross section, FIGS. 3 and 4, and the included angle between the divergent side walls of each finger 38 preferably decreases and becomes more acute toward the downstream tips of the fingers as may be observed in FIGS. 3 and 4. Well defined equal width gas passages 39 or slots are formed between the several fingers 38 throughout the major portion of the length of the female sleeve element. Additionally, the depths of the channels defined by the approximately V-shaped fingers 38 increases from zero at the cylindrical portion 37 to maximum depth at the downstream ends of the unit 15 as can be clearly seen in FIGS. 5, 2 and 4. Additionally, the longitudinal edges of each finger 38 are provided with a plurality of spaced teeth 40 of gradually increasing size toward the downstream tips of the fingers 38. These described elements of the female sleeve 26 are somewhat critical in their formations and coact in an important manner with each other and with the male interior jet 31 to produce violent agitation of the diverted combustion products, as well as comminution thereof in the recycling unit 15.

As can be seen clearly in FIGS. 2 and 4, the teeth 40 near the downstream tips of the fingers 38 engage within and bear on the collar 25 of nipple 24 for the firm support and centering of the sleeve element 26. The tips or ends of the channel-like fingers 38, FIG. 2, also abut the end wall of coupling nut 28 for added stability in the assembly.

The downstream end of male jet 31 terminates within female sleeve 26 with the ports approximately at the longitudinal center of the sleeve 26 and unit 15. The downstream end of jet 31 contacts the interior sides of the several fingers 38 in the assembled unit and is partly supported and stabilized thereby while the extension 33 is supported in the bore 34, as described. The construction is very simple and once the unit 15 is properly assembled, it requires no further adjustment or maintenance but can be taken apart readily at infrequent intervals for cleaning or servicing.

In operation, exhaust products, including unburned fuel constituents, are bled from the exhaust manifolds 11 and 12 and are delivered to the unit 15 by the pipes 16 and 17 and T-coupling 18. Upon entry into the recyling unit 15 through bore 34, the exhaust products pass through central bore 35 and radial ports 36 of the male jet element 31 at high velocities. From the bore 35 and ports 36, the exhaust products enter the female sleeve element 26 and impinge on the fingers 38 and also pass through the slots 39 between these fingers toward the wall of sleeve 15. All of this subjects the gaseous products to violent agitation and comminution and the teeth 40 aid in this process. Eventually, the agitated combustion products will enter the pipe 23 leading to the carburetor and will be inducted into the engine with cold fresh air. In the engine combustion process, the usable recycled fuel components will be burned and the final exhaust from the engine tailpipe will be substantially pure and ridded almost completely of dangerous carbon monoxide.

It is to be understood that the form of the invention herewith shown and described is to be taken as a preferred example of the same, and that various changes in the shape, size and arrangement of parts may be resorted to, without departing from the spirit of the invention or scope of the subjoined claims.

We claim:

1. A device for recycling combustion products in an internal combustion engine to remove carbon monoxide therefrom and to more completely burn the combustion products comprising a sleeve member forming a housing, conduit means coupling opposite ends of said sleeve member to an engine exhaust and engine fuel induction means, a male jet element supported centrally within said sleeve member in spaced relation thereto and being coaxial therewith and extending through a major portion of the length of the sleeve member and having a downstream end terminating within the sleeve member, said male jet element having a central axial bore formed therethrough from end-to-end and having plural circumferentially spaced longitudinal rows of radial ports leading from the central axial bore and opening through the peripheral surface of the male jet element approximately at the longitudinal center zone of the sleeve member, and a coacting female sleeve element inside of said sleeve member and being supported thereby in coaxial surrounding relationship to the male jet element, said female sleeve element having a plurality of elongated circumferentially spaced fingers of channel form extending for the major portion of its length and said fingers having free separated ends at the downstream end of the device, and said fingers having toothed longitudinal edges.

2. A device for recycling combustion products in an internal combustion engine as defined in claim 1, and said conduit means including a T-coupling and pipes connected with inlets of the T-coupling and leading from exhaust manifold sections of an engine.

3. A device for recycling combustion products in an internal combustion engine as defined in claim 1, and said spaced fingers of the female sleeve element engaging the downstream end portion of said male jet to support and center it relative to said sleeve member.

4. A device for recycling combustion products in an internal combustion engine as defined in claim 1, and said fingers of channel form being approximately V-shaped in cross section and the channels formed by the side walls of the fingers increasing in depth gradually toward the downstream tips of the fingers, the longitudinal edges of said side walls being toothed.

5. A device for recycling combustion products in an internal combustion engine as defined in claim 4, and the teeth on said fingers increasing in size gradually toward the downstream tips of the fingers.

6. A device for recycling combustion products in an internal combustion engine as defined in claim 1, and said sleeve member having a reduced diameter collar on the downstream end thereof, and downstream end portions of said fingers resting on and centered by said collar.

7. A device for recycling combustion products in an internal combustion engine as defined in claim 1, wherein said sleeve member is an externally threaded sleeve, and a pair of coupling nuts on opposite ends of the threaded sleeve and engaged with said conduit means and forming end closures for the housing formed by the sleeve member.

8. A device for recycling combustion products in an internal combustion engine as defined in claim 1, and said male jet element comprising an elongated cylindrical body portion having an upstream reduced diameter end, said end seated and supported within a bore of said conduit means.

9. A device for recycling combustion products in an internal combustion engine to remove carbon monoxide from the final exhaust and to more completely burn the combustion products, said device comprising a sleeve member forming a housing and adapted for coupling between an engine exhaust system an engine fuel induction means, a male jet element disposed centrally within the sleeve member in spaced relation thereto and having a central longitudinal bore and plural radiating ports leading from said bore substantially centrally of the sleeve member, and a coacting female sleeve element within said sleeve member and supported thereby in surrounding relationship to said male jet element and being slotted to define plural spaced longitudinal fingers on said female sleeve element and passages between said fingers, whereby gaseous products passing through the bore and radiating ports of the male jet element enter the interior of the female sleeve element and the passages between said fingers prior to being released from said sleeve member for return to an engine through the carburetor thereof.

* * * * *